US005779437A

United States Patent [19]

Abdel-Messeh et al.

[11] Patent Number: 5,779,437

[45] Date of Patent: Jul. 14, 1998

[54] COOLING PASSAGES FOR AIRFOIL LEADING EDGE

[75] Inventors: William Abdel-Messeh, Beloeil; Ian Tibbott, St. Burno, both of Canada; Subhash Arora, Phoenix, Ariz.

[73] Assignee: Pratt & Whitney Canada Inc., Longueuil, Canada

[21] Appl. No.: 742,258

[22] Filed: Oct. 31, 1996

[51] Int. Cl.[6] ..... F04D 29/38

[52] U.S. Cl. ..... 415/115; 416/97 R

[58] Field of Search ..... 415/115, 116; 416/97 R

[56] References Cited

U.S. PATENT DOCUMENTS 5,342,172 8/1994 Coudray et al. ..... 416/97 R 5,382,133 1/1995 Moore et al. ..... 415/115

5,486,093 1/1996 Auxier et al. ..... 416/97 R 5,496,151 3/1996 Coudray et al. ..... 415/115

5,577,889 11/1996 Terazaki et al. ..... 416/97 R

*Primary Examiner*—John T. Kwon

*Attorney, Agent, or Firm*—Jeffrey W. Astle

[57] ABSTRACT

A cooling structure for the leading edge area of an airfoil having a plurality of passages wherein each passage has a radial component and a downstream component relative to the leading edge axis, and the outlet of each passage has a diffuser area formed by conical machining, wherein the diffuser area is recessed in the wall portion downstream of the passage.

7 Claims, 3 Drawing Sheets

COOLING PASSAGES FOR AIRFOIL LEADING EDGE

BACKGROUND OF THE INVENTION

1. Field of the Invention

The present invention relates to gas turbine engines, and more particularly, to a vane or blade airfoil in the turbine section of the engine and cooling systems for such airfoils.

2. Description of the Prior Art

High performance gas turbine engines operate at very high temperatures, requiring elaborate cooling systems to protect the exposed airfoil. In order to remove the excess heat from the airfoil, conventional airfoil cooling involves the provision of a hollow airfoil, defining a cavity, with an insert tube, in the case of a vane, for conducting cooling air, from the compressor section of the engine, into the cavity. The tube is provided with openings forming jets for impinging the coolant air onto the interior surface of the airfoil wall. Coolant air is also channeled within the cavity of the airfoil to increase the heat convection from the internal surface of the airfoil wall. However, the airfoil is subject to a non-uniform external heat load distribution with the highest load being near the leading edge of the airfoil.

A most effective cooling method is the formation of a protective insulating film on the exterior of the airfoil surface. Film cooling involves ejecting coolant air through discrete passages formed in the airfoil wall. The coolant air used to form a film on the exterior surface of the airfoil is coolant air that has first been used as impinging air on the interior of the airfoil. Further, the same coolant air removes further heat from the airfoil as it is ejected through the discrete passages, so that the cooling effect of these various methods is cumulative.

However, the internal cooling, by impingement, channeling and ejection, known as convective cooling, is a function of flow rate. While increasing the flow rate increases the rate of heat removal, the same has the effect of increasing the jet velocity of the coolant air as it is ejected from the discrete passages, thereby causing the coolant air to penetrate further into the hot gas flow path increasing the mixing of the coolant air with the hot gases, which is detrimental to the formation of a protective, insulating film on the surface of the airfoil.

Furthermore, vortices will be formed in the vicinity of the passage outlet. These vortices tend to draw hot gases from the hot gas stream to the airfoil surface near the passage outlet, giving rise to higher local heat loads. The conventional cylindrical passages extending normal to the airfoil exterior surface are most susceptible to such deficiencies.

There have been several attempts to improve the formation of an insulating, protective film on the airfoil. Such attempts include U.S. Pat. No. 3,527,543 to Howald, issued Sep. 8, 1970. The Howald patent shows cooling holes in the airfoil downstream direction relative to the flow path. In other words, the holes of Howald, although inclined in the radial direction, extend in planes that are normal to the outer surface of the airfoil. This provides little diffusion of the coolant air in the downstream area of the hole, thereby allowing the coolant air jet to penetrate the hot gases in the flow path, depending on the flow rate of the coolant air rather than forming a film downstream of the hole. This is particularly inappropriate in the leading edge area of the airfoil where an effective cooling film on the airfoil surface is essential. Furthermore, the Howald holes are relatively short since they extend in a plane at right angles to the airfoil outer surface and thus fail to provide sufficient convective cooling at high gas temperatures.

In the case of U.S. Pat. No. 4,684,323 to Field, issued Aug. 4, 1987, the holes or passages extend almost exclusively in the downstream direction without a radial component. The rectangular diffusion section of the prior art, according to Field, is subject to separation risking the penetration of hot gases into the passage. The solution proposed by Field is to round out the side walls of the diffuser section allowing a greater divergent angle at the side walls. However, it is evident that if Field was to orient the passages to provide a radial component, separation would be prevalent in the diffuser sections.

SUMMARY OF THE INVENTION

It is an aim of the present invention to provide an improved air coolant passage design that would overcome the deficiencies of the prior art, as represented by Howald and Field, and improve the formation of a protective, insulating film primarily at the leading edge of the airfoil.

It is a further aim of the present invention to provide a coolant air passage that has increased convective cooling of the airfoil wall than that afforded by the prior art.

It is a still further aim of the present invention to provide an improved pattern of airfoil passages so as to lay down a more uniform protective insulating film on the airfoil surface, particularly in the leading edge area of the airfoil.

In a construction in accordance with the present invention, there is provided a wall for the leading edge portion of an airfoil located in a hot gas flow path, wherein passages are provided in the wall on either side of a radial leading edge axis passing through a stagnation point on the wall, relative to the flow path, each passage has a straight cylindrical bore portion and a conical portion forming the outlet thereof, each passage extends through the wall at an angle having a radial component and a downstream component relative to the leading edge axis such that the conical outlet forms a diffuser area recessed in the surface of the wall of the airfoil in at least the downstream portion relative to the outlet of the passage.

In a more specific embodiment in accordance with the present invention, a cooling structure is provided for an airfoil in a gas turbine engine wherein the airfoil extends radially in the hot gas flow path, the airfoil having a wall defining a leading edge area with an external curved surface having a center of curvature within the airfoil, a radial leading edge axis coincident with the stagnation point in the leading edge area of the wall, a trailing edge on the airfoil wall downstream of the flow path, the wall having a pressure surface and a suction surface, the airfoil having a hollow interior for the passage of coolant air, a plurality of air coolant passages defined in the leading edge area of the wall, the plurality of passages forming a pattern, each passage having a straight cylindrical metering bore section and a diffuser section forming an outlet at the intersection with the curved surface of the wall, the improvement comprising that each passage has a centerline extending (i) with a radial component at an angle $\alpha$ relative to the leading edge axis where $15° \leqq \alpha \leqq 60°$, and (ii) with a downstream component at an angle $\theta$ from a line extending between the center of the leading edge curvature and a point at the intersection of the centerline of the passage and the leading edge surface, where $10° \leqq \theta \leqq 45°$, and wherein the diffuser section is partially conical with an axis that is substantially coincident with the centerline of the passage forming a diffuser area in the downstream portion of the airfoil surface as part of the outlet of the respective passage.

In a more specific embodiment, the pattern includes at least a pair of radially extending rows on either side of the leading edge axis such that the outlets of one row of a pair are staggered downstream relative to the outlets of the other row in the pair.

The configuration of the coolant air passages in the leading edge area provides a longer passage in the wall, thereby increasing the convective effectiveness of the coolant air flowing through the passage. The formation of the diffuser area having a partial cone configuration enhances the formation of the protective, insulating film on the surface of the airfoil downstream of the outlet of the passage, at all conceivable coolant air flow rates in the passage. It has also been found that the particular shape of the partial conical diffuser area avoids separation of the flow at the outlet. The combination of the longer passage in the wall of the airfoil and the higher permissible flow rate of the coolant air further augments the convective heat removal from the airfoil wall. It has also been found that the shape of the outlet and diffuser area increases the film coverage of each passage such that ultimately fewer film coolant passages are required to cover a given airfoil span.

Furthermore, because of the design of the outlet diffusion area, the coolant flow rate decelerates at the outlet while at the same time, since the passageway is inclined at a smaller cc angle, the flow is ejected from the passageway almost tangentially to the airfoil surface which is further enhanced by the compound conical shape of the outlet diffuser area.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
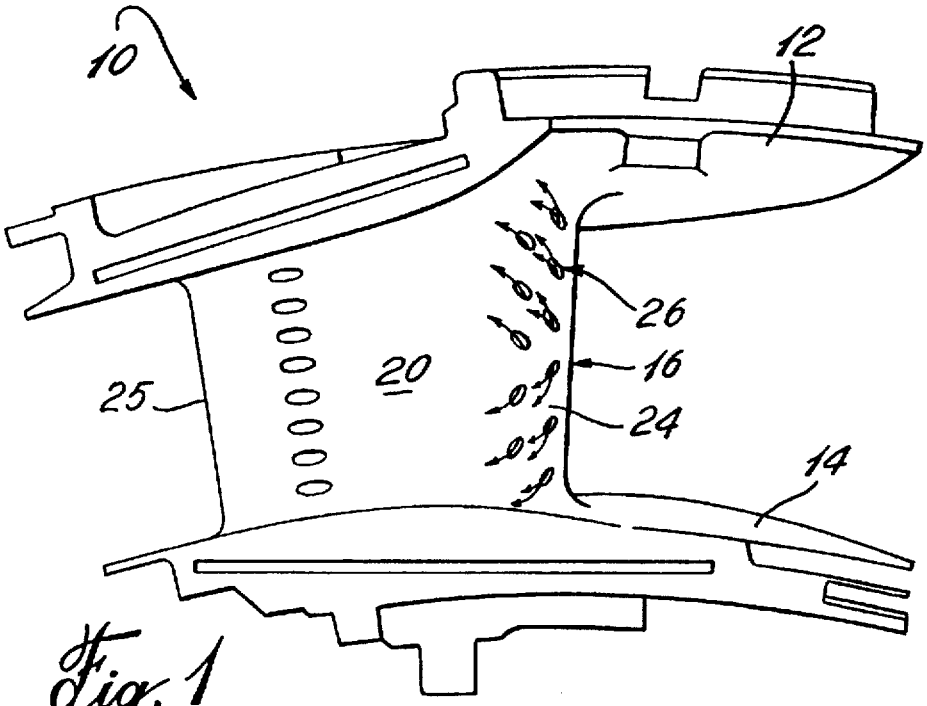
FIG. 1 is a perspective view of a turbine guide vane in accordance with the present invention.
Figure 2:
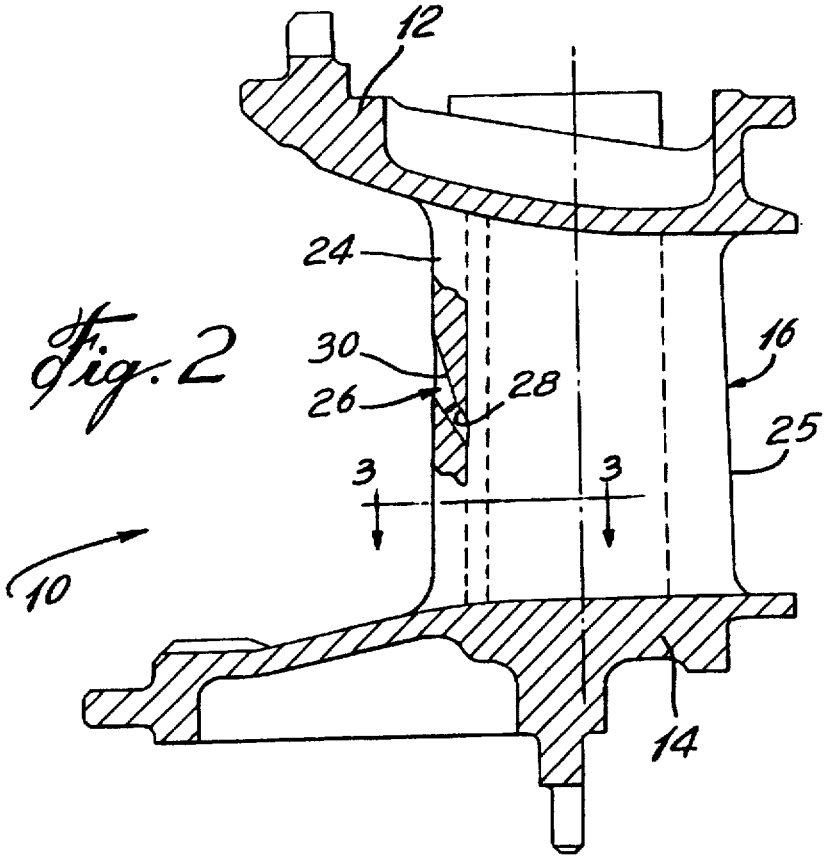
FIG. 2 is a side elevation of the vane shown in FIG. 1, partly in cross-section.

Referring now to FIGS. 1 and 2, there is shown a guide vane 10 suitable for a first stage in the turbine section of a gas turbine engine. The vane 10 includes an outer platform 12 and an inner platform 14. An airfoil 16 extends radially between the inner and outer platforms. The airfoil includes a leading edge area 24 and a trailing edge 25.

A rotating airfoil, such as a blade, would have a different physical structure from a stationary vane. However, a person skilled in the art would recognize how to adapt the present invention for use in an air cooled rotating airfoil.

Figure 3:
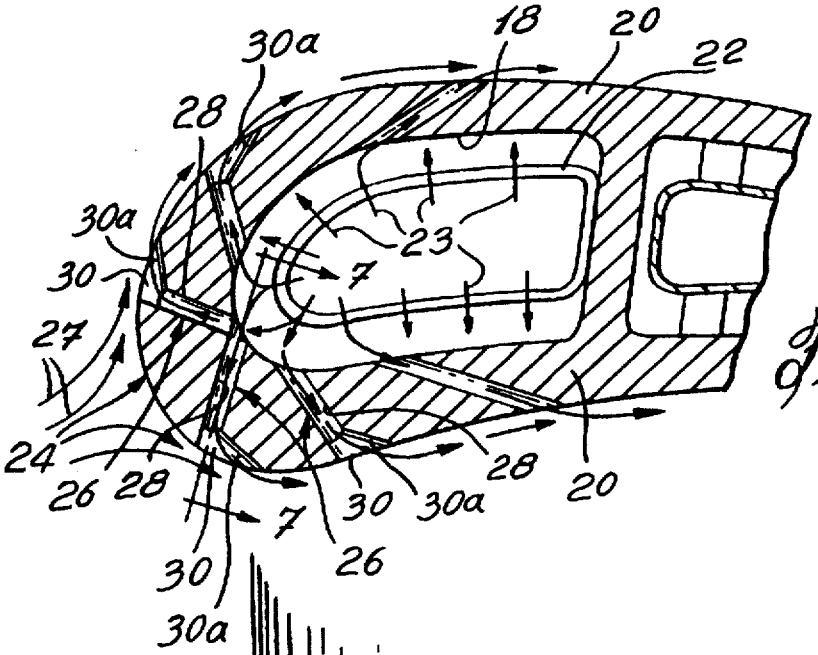
FIG. 3 is a horizontal fragmentary cross-section taken along line 3—3 of FIG. 2.

FIG. 3 is a cross-section of the airfoil showing an inner cavity 18 and the airfoil exterior wall 20. A tube 22 is provided within the cavity 18 for the purpose of passing coolant air bled from the engine compressor. As shown by the arrows 23, the coolant air is impinged upon the interior surface of the wall 20.

Figure 3A:
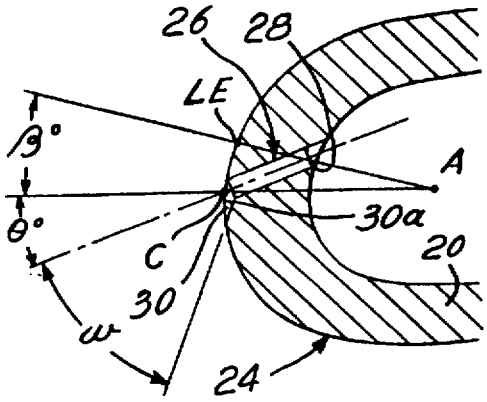
FIG. 3*a* is an enlarged schematic view of a detail of FIG. 3.
Figure 4:
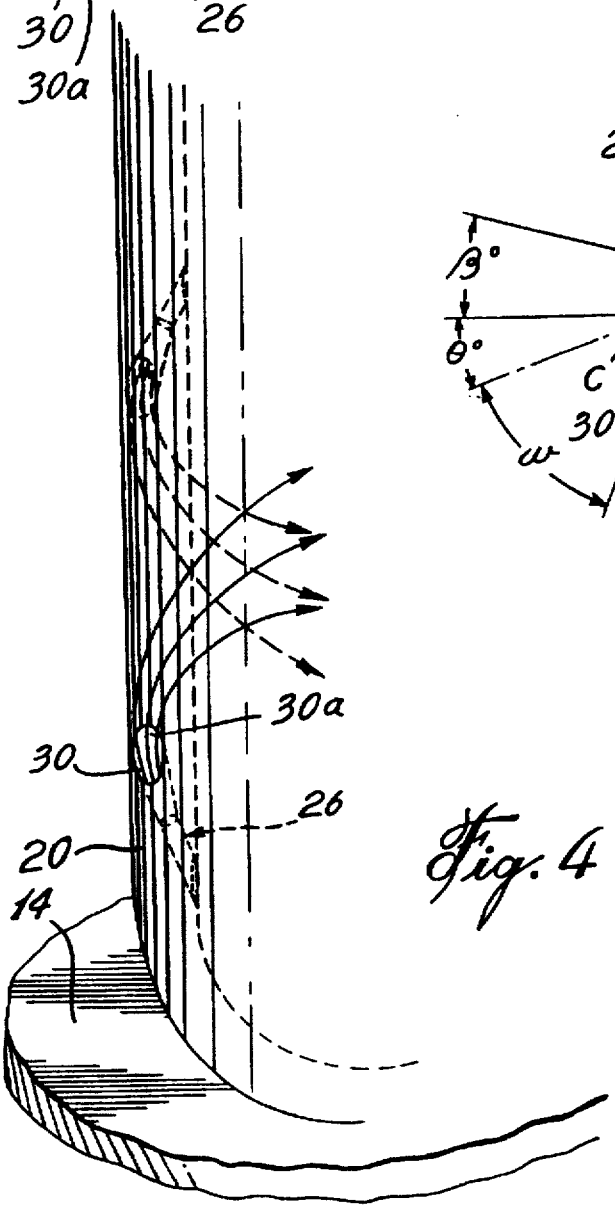
FIG. 4 is a fragmentary perspective view of a detail of the invention.

A stagnation point can be determined on the leading edge area 24 of the airfoil 16 within the flow path represented by the arrows 27. For the purposes of this description, a leading edge axis LE extends radially through the stagnation point. The point LE in FIG. 3*a* represents this leading edge axis.

Figure 6:
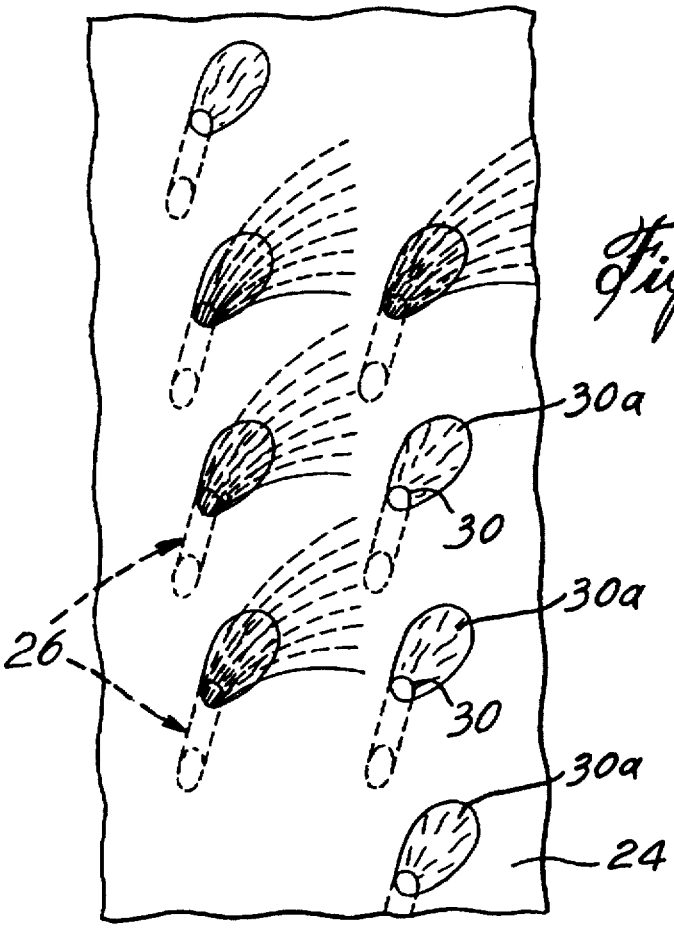
FIG. 6 is a fragmentary schematic view of a pattern of film-forming passages in accordance with the present invention.
Figure 7:
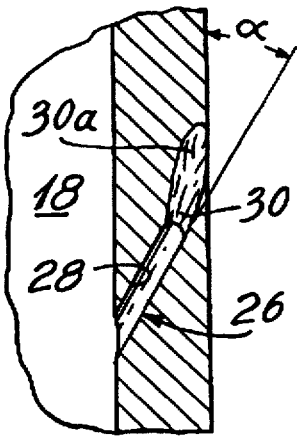
FIG. 7 is a fragmentary, enlarged, vertical cross-section taken along line 7—7 in FIG. 3.
Figure 5:
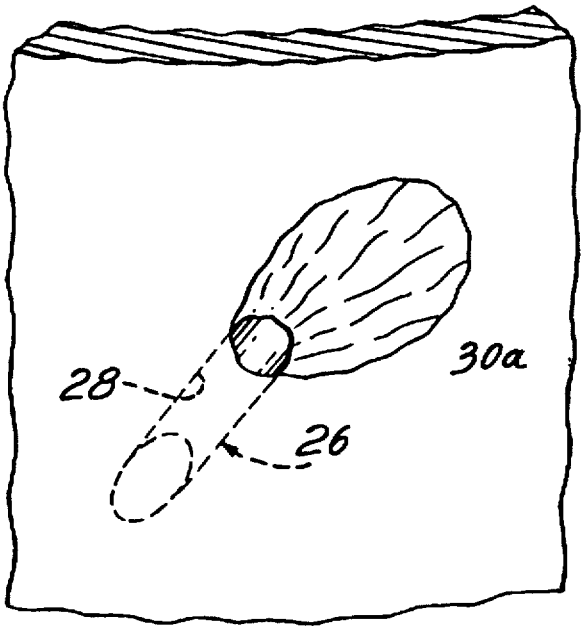
FIG. 5 is an enlarged fragmentary perspective view of a detail shown in FIG. 4.

Passages 26 are provided in the leading edge area 24 of the airfoil 16. A typical pattern of passages 26, in accordance with the present invention, which would appear on either side of the leading edge axis LE, is shown in FIG. 6. The passage 26 is illustrated in detail in FIGS. 3, 3*a*, 4, 5, and 7. The passage 26 generally includes a cylindrical straight "metering" bore 28 which extends at an angular orientation as will be described below, from the inner surface of the wall 20 to the outer surface. As best shown in FIG. 7, the angular component of the passage 26 in the radial direction is represented by a with respect to the leading edge surface and the centerline of the bore 28.

The angle $\alpha$ is preferably small so that the passage 26 extends for the longest possible distance within the wall 20. The radial component of the passage 26 may be directed outwardly towards the platform 12 or inwardly towards the inner platform 14. In a rotating airfoil, the radial component would be preferably directed outwardly.

The passage 26, relative to the leading edge axis LE, has a downstream component described below in connection with its angular components on a plane perpendicular to the axis LE. In FIG. 3*a*, the center of curvature of the leading edge area 24 is represented by the point A. Point C represents the projected intersection of the centerline of the passage 26 with the outer surface of the leading edge area 24. The angle $\beta$ is between a line drawn through points A and LE and A and C. The angle $\theta$ represents the angle between the line A–C and the centerline of the passage 26.

Angle $\theta$ should be as large as possible but is limited by the configuration of the wall 20, and in particular, the radius of curvature. For a given wall thickness, the larger the radius, the larger the angle $\theta$ can be. It is also noted that the farthest away the passage outlet 30 can be from the leading edge axis LE, that is, the greater the angle $\beta$, the greater the angle $\theta$ can be. However, it is preferred that the passage 26 and outlet 30 be as close as possible to the leading edge axis LE and, therefore, the angle $\beta$ should be relatively small, thereby compromising angle $\theta$.

The designer must attempt to have the smallest possible angle $\alpha$ and the largest possible angle $\theta$. It is noted that as the angle $\theta$ approaches 0, the passage 26 approaches a plane which is at right angles to the outer surface of the leading edge area 24. The angular orientation relative to axis LE and center of curvature A of passage 26 can, therefore, be represented by $15° \leqq \alpha \leqq 60°$ and where $10° \leqq \theta \leqq 45°$.

The outlet 30 and the diffuser area 30*a* is formed by machining a substantially cone-shaped opening at the outlet 30. The cone can have a divergent angle of $2\omega$ where $\omega$ is between 5° and 20°. The axis of the cone is coincident or parallel with the centerline of the passage 26. A portion of the cone-shaped opening is machined in the wall that is downstream relative to the leading edge axis LE, and the depth of the cone will be determined by the projected intersection of the cone and the outer edge of the passage 26 nearest the leading edge axis LE. Thus, the conical surface is machined in the wall 20 only on the downstream side, and in view of the angular orientation of the passageway 26, it will result primarily in a quadrant farthest away from the leading edge axis. If the passage 26 extends towards the outer platform, the diffuser area 30*a* can be said to be in the downstream outer quadrant. The ratio of area $A_o$ represented by the outlet 30, including the diffuser area 30*a*, to the cross-sectional area $A_i$ of the cylindrical portion of the passage 28, is preferably $2.5 \leqq A_o/A_i \leqq 3.6$.

A pattern of outlets 30 of the passages 26, as shown in FIG. 6, includes two radial rows thereof with the outlets 30 staggered relative to the outlets in an adjacent row. Thus, the coolant air being laid in a film from each passage 26 is uniformly spread in order to cover the complete airfoil surface in the leading edge area 24.

Although described with respect to stationary vanes, these coolant passages may also be used in rotating airfoils (i.e., turbine blades), with orientations adapted to the external and internal geometry of the blade.

The passage 26 may be formed in the airfoil wall 20 by means of electro-discharge or laser methods, as is well known in the art. From a manufacturing perspective, it may be necessary to approximate the conical diffusion component of the outlet 30 by drilling several grooves or craters in the surface of the airfoil in the downstream outer quadrant adjacent to passages 26 extending towards the center platform and/or in the downstream inner quadrant adjacent to passages 26 extending towards the inner platform.

We claim:

1. A cooling system for a wall at the leading edge portion of a hollow airfoil located in a hot gas flow path, including passages defined in the wall on either side of a radial leading edge axis passing through a stagnation point on the wall, relative to the flow path, each passage having a straight cylindrical bore portion with a conical portion forming the outlet thereof, each passage extending through the wall at an angle having a radial component and a downstream component relative to the leading edge axis such that the conical outlet forms a diffuser area recessed in the surface of the wall of the airfoil in the downstream portion of the outlet of the passage.

2. A cooling system for the airfoil as defined in claim 1, wherein the centerline of the passage has the radial component expressed at an angle $15° \leqq \alpha \leqq 60°$ and the downstream component where the angle is at $10° \leqq \theta \leqq 45°$, where $\alpha$ is the angle in the radial direction relative to the leading edge axis, while $\theta$ is the angle between the centerline of the passage and a line through the center of curvature of the wall and the point of intersection of the centerline of the passage with the leading edge surface area on the wall.

3. A cooling structure for an airfoil in a gas turbine engine, wherein the airfoil extends radially in the hot gas flow path, the airfoil having a wall defining a leading edge area with an external curved surface having a center of curvature within the airfoil, a radial leading edge axis coincident with the stagnation point in the leading edge area of the wall relative to the flow path, a trailing edge on the airfoil wall downstream of the flow path, the wall having an outer pressure surface and a suction surface, the airfoil having a hollow interior for the passage of coolant air, a plurality of air coolant passages defined in the leading edge area of the wall, the plurality of passages forming a pattern, each passage having a straight cylindrical metering bore section and a diffuser section forming an outlet at the inter-section with the curved surface of the wall, the improvement comprising that each passage has a centerline extending (i) with a radial component at an angle $\alpha$ relative to the leading edge axis where $15° \leqq \alpha \leqq 60°$, and (ii) with a downstream component at an angle $\theta$ where $10° \leqq \theta \leqq 15°$ from a line extending between said center of curvature and a point at the intersection of the centerline of the passage and the leading edge area of the wall, and wherein the diffuser section is partially conical with an axis that is substantially coincident with the axis of the passage forming a diffuser area in the downstream portion of the wall at the outlet of the passage.

4. A cooling structure for an airfoil as defined in claim 3, wherein the line between the center of curvature and the point of intersection on the centerline of the passageway and the leading edge area on the wall is downstream from the leading edge axis by the value of angle $\beta$, where $-90° \leqq \beta \leqq +90°$.

5. A cooling structure as defined in claim 3, wherein the area of the outlet $A_o$ compared to the area of the cross-section of the straight cylindrical portion of the passage $A_i$ has a value of $2.5 \leqq A_o/A_i \leqq 3.6$.

6. The cooling structure as defined in claim 3, wherein the pattern includes at least a pair of radially extending rows on either side of the leading edge axis such that the outlets of one row of a pair are staggered relative to the outlets of the other row in the pair.

7. The cooling structure as defined in claim 3, wherein the cone has a divergent angle of $2\omega$ where $5° \leqq \omega \leqq 20°$.

* * * * *